United States Patent [19]

Belohlavek

[11] 4,335,299

[45] Jun. 15, 1982

[54] THERMOSTATIC CONTROL FOR ELECTRIC ROOF HEATING CABLE

[76] Inventor: James F. Belohlavek, 647 Range Line Rd., Mosinee, Wis. 54455

[21] Appl. No.: 191,919

[22] Filed: Sep. 29, 1980

[51] Int. Cl.[3] ..... H05B 1/02

[52] U.S. Cl. ..... 219/510; 219/507; 219/508; 219/512; 219/213; 340/580; 236/91 R

[58] Field of Search ..... 219/508–511, 219/513, 518, 519, 203, 213, 359, 364; 236/1, 47, 91 R; 340/501, 580, 581

[56] References Cited

U.S. PATENT DOCUMENTS

| | | | |
|---|---|---|---|
| 2,699,484 | 1/1955 | Michaels | 219/213 |
| 3,233,078 | 2/1966 | Siemianowski | 219/213 |
| 3,540,655 | 11/1970 | Hinrichs | 219/213 X |
| 3,582,612 | 6/1971 | Siemianowski | 219/213 |
| 3,725,638 | 4/1973 | Solin et al. | 219/213 |

FOREIGN PATENT DOCUMENTS

| | | | |
|---|---|---|---|
| 219328 | 2/1968 | Sweden | 219/213 |

*Primary Examiner*—B. A. Reynolds
*Assistant Examiner*—M. Paschall
*Attorney, Agent, or Firm*—Keith Schoff

[57] ABSTRACT

A thermostatic control for electric cables used on overhanging eaves of pitched roofs in northern climates, and in rain gutters and downspouts, comprises a high temperature-limit switch and a low temperature-limit switch connected in series circuit for controlling energization to a narrow temperature range extending from the freezing temperature of water to several degrees colder. Above-freezing temperatures will melt ice and snow without supplemental heating, and sufficiently colder temperatures will not be raised sufficiently by heat loss through a building roof to thaw ice and snow accumulation on the roof and provide run-off water to the unheated eave, rain gutter and downspout where freezing can occur and result in the formation of an ice dam which will block drainage of further run-off water and which may grow in size to cause water to back-up and seep under roofing shingles to leak through the roof.

4 Claims, 2 Drawing Figures

THERMOSTATIC CONTROL FOR ELECTRIC ROOF HEATING CABLE

BACKGROUND OF THE INVENTION

Roof heating tapes are used widely by being installed on the overhanging eave of a sloped roof for melting accumulations of ice and snow which form there at ambient temperature conditions which are conducive to melting ice and snow on the portion of the roof over heated premises, where warming is provided by heat loss through the roof, but which do not prevent freezing of run-off water at the unheated eave and in the rain gutter and downspout. An ice dam will form backing further run-off water up the slope of the roof and under the roof covering causing leakage. Heating tapes are commonly provided with manually controlled switches with little attention being paid to energy efficient control and use.

PRIOR ART

U.S. Pat. No. 3,725,638 shows an electric heating cable placed on a roof and provided with a temperature controlled switch set to energize the cable at about 35 degrees Fahrenheit. U.S. Pat. Nos. 3,582,612 and 3,823,304 show similar installations provided with water sensing switch controls. U.S. Pat. No. 3,806,702 shows an electrically heated mat controlled by the combination of a temperature sensing component and a precipitation sensor, and similarly U.S. Pat. No. 3,540,655 shows a pavement de-icer utilizing a thermostat and a humidistat.

DESCRIPTION OF THE INVENTION

Figure 1:
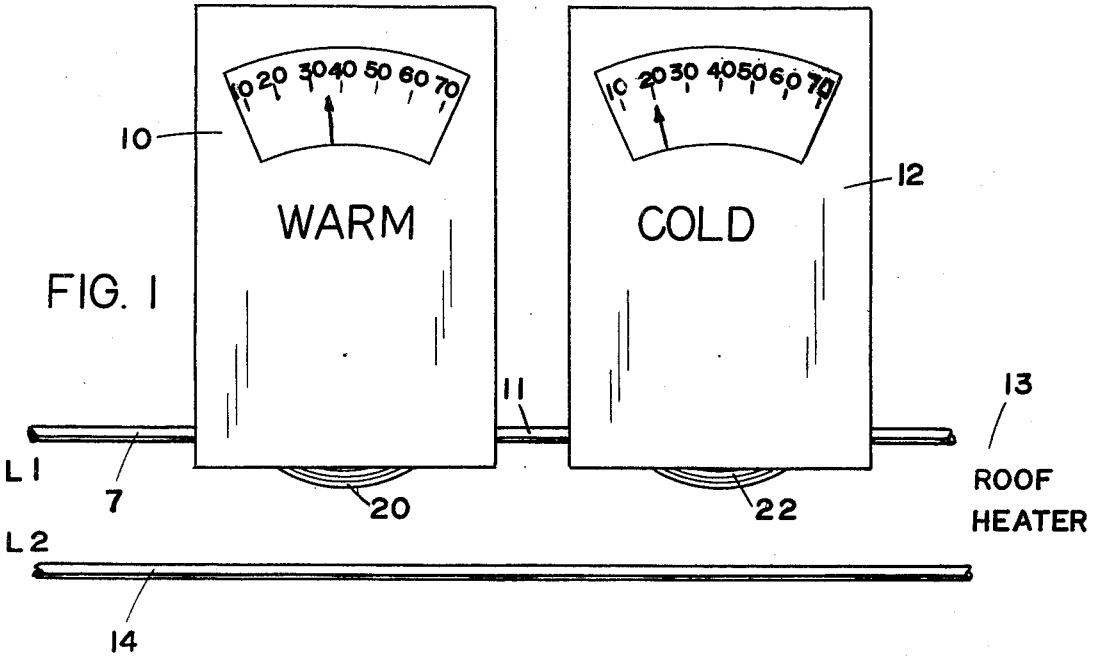
FIG. 1 is a schematic elevation of a thermostatic heating control embodiment of this invention.
Figure 2:
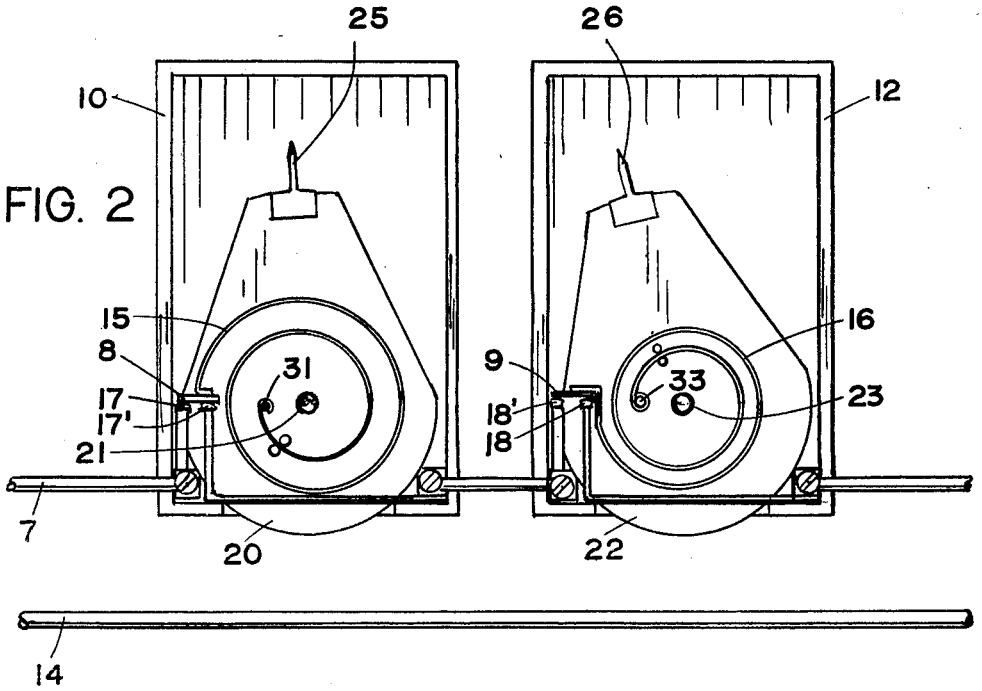
FIG. 2 is a circuit diagram of the embodiment of FIG. 1.

Referring to FIGS. 1 and 2, a conventional heating control thermostat 10 is connected in series by conductor 11 to conventional cooling control thermostat 12. The circuit in which the thermostats are disposed comprises in addition line current conductor 7 forming portion LI of the circuit, neutral conductor 14 forming portion L2 of the circuit, and a permanently connected or removable plug connected load 13 which may be a roof heater as indicated in FIG. 1 such as a roof heating tape, or a relay switch controlling line current, in which case a step-down transformer, not shown, will be incorporated in LI to typically provide a six volt control circuit in parallel with line current. The foregoing components and circuitry options are conventional and individually constitute no part of this invention.

As shown in FIG. 2, thermostats 10 and 12 comprise bi-metal elements 15, 16 respectively, which through means of differential thermal expansion of two superimposed, unitarily connected strip of dissimilar metals cause contact points 8 and 9, respectively, to be biased toward or away from circuit contact points 17, 17', and 18, 18' respectively, thereby causing the circuit to be opened and closed responsively to ambient temperature sensed by the bi-metal elements. Bi-metal elements 15 and 16 are curvilinearly configured and are anchored by anchor pins 31, 33, respectively, to dials 20 and 22 together with set pins 21 and 23 to which indicating pointers 25 and 26 are respectively attached. Dials 20 and 22 and attached pins 21 and 23 provide means for manually adjusting the temperature control settings of the thermostats. Preferably, thermostat 10 will be set at about 35 degrees Fahrenheit to provide for contact points 8, 17, and 17' to be closed below such temperature, and thermostat 12 will be set at about 20 degrees Fahrenheit to provide that contact points 9, 18, and 18' will be closed above such temperature, thus providing a closed circuit in the temperature range between 20 degrees and 35 degrees Fahrenheit and an open circuit otherwise.

Thermostatic control means other than bi-metal elements may be used such as those comprising expandable-fluid filled bulbs, such means being conventional and the use thereof in this invention being apparent to those familiar in the art. Controls having bi-metal elements of the type shown will preferably be mounted near an eave on which a roof heating tape is installed, such as on the roof soffit. A remote sensing thermostat may be conveniently be mounted inside with the sensing element disposed at the eave.

Any setting of the thermostatic control may be provided, as desired, roof heating tapes being most efficiently used to prevent freezing at the eave of run off water from the portion of the roof over heated premises by locating them on the face of the roof at the eave, in the rain gutter or downspout and controlling them to be energized at temperatures in a range from slightly above freezing to ten or fifteen degrees colder, depending on the amount of heat lost by conduction through the roof. Some heat will be lost through the roof of heated premises and for a given temperature range will contribute sufficiently to that resulting from air temperature and solar insulation to melt snow on the portion of the roof over heated premises with the melt water freezing at the eave where there is absent warming from heat loss through the roof. An ice dam forms at the eave and may at times provide sufficient blockage of run off water to back the water up the slope of the roof and under shingles or other roof covering, later to freeze and thaw alternately with changes in temperature and to leak and cause structural damage.

Manual control of heating tape switches is inherently wasteful because of operator inattentiveness to changes in ambient temperature changes at the eave of the roof resulting from change in air temperature or of solar insulation because of time of day or cloud conditions. In the manner conventional for thermostatic control circuits generally, however, it is desirable in the embodiments of this invention to provide a manual switch for removing the circuit from operation during the portions of the year when heating tapes are not required. Solid state switching components may be used in the embodiments of this invention, if desired, as will be apparent to a person skilled in the art, and temperature sensing elements of conventional design other than those described herein may be employed in obvious manner.

I claim:

1. Differential thermostatic control for a roof heating tape comprising a first electric circuit component embodying contact points and temperature responsive biasing means wherein said contact points are opened by said biasing means by increase in ambient air temperature sensed above an upper temperature control limit, a second electric circuit component embodying contact points and temperature responsive biasing means wherein said contact points are opened by said biasing means by decrease in ambient air temperature sensed below a lower temperature control limit, said first electric circuit component and said second electric circuit component being connected in series circuit without substantial voltage drop thereacross for controlling energization of load.

2. The apparatus of claim 1 wherein said load comprises roof heating tape.

3. The apparatus of claim 1 wherein said load comprises a switch relay for roof heating tape.

4. The apparatus of claim 1 wherein said temperature responsive biasing means comprise adjustable means for selecting temperature setting.

* * * * *